US010020136B2

(12) United States Patent
Wu et al.

(10) Patent No.: US 10,020,136 B2
(45) **Date of Patent: *Jul. 10, 2018**

(54) SWITCH WIRE CONNECTION DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Cherng Shin Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/294,963

(22) Filed: Oct. 17, 2016

(65) Prior Publication Data

US 2017/0110267 A1 Apr. 20, 2017

(30) Foreign Application Priority Data

Oct. 19, 2015 (TW) ..... 104216729 A
Oct. 20, 2015 (TW) ..... 104134448 A

(51) Int. Cl.
*H01H 1/58* (2006.01)
*H01H 13/14* (2006.01)
*H01H 1/20* (2006.01)

(52) U.S. Cl.
CPC ..... *H01H 13/14* (2013.01); *H01H 1/20* (2013.01); *H01H 1/5844* (2013.01)

(58) Field of Classification Search
CPC ..... H01H 13/14; H01H 13/18; H01H 13/183–1/5844; H01R 13/701–4/4818; H01R 4/4845
USPC ..... 200/530, 532, 284; 439/816, 438
See application file for complete search history.

(56) References Cited

U.S. PATENT DOCUMENTS 4,806,711 A * 2/1989 Eckhaus ..... H01H 1/585 200/61.62
5,322,983 A * 6/1994 Tseng ..... H01H 15/06 200/547
7,625,253 B2 * 12/2009 Eppe ..... H01R 4/4836 439/835
9,466,911 B1 * 10/2016 Wu ..... H01R 4/4836
2017/0110264 A1 * 4/2017 Wu ..... H01H 1/58

* cited by examiner

*Primary Examiner* — Vanessa Girardi
(74) *Attorney, Agent, or Firm* — Rosenberg, Klein & Lee

(57) ABSTRACT

A switch wire connection device has a simplified structure and is easy to operate with enhanced stability of operation. The switch wire connection device includes a conductive component mounted in an insulation case, a switch pushbutton assembled with the conductive component and an electrical contact. The electrical contact has a restriction unit and a contact plate connected with the restriction unit. By means of operating the pushbutton, the conductive component is driven to selectively electrically contact or separate from the contact plate. The restriction unit defines a space, in which a metal leaf spring is assembled. The wiring circuit or conductive wire of a machine or equipment can be easily directly plugged into the space of the restriction unit and held by the metal leaf spring. The metal leaf spring is prevented from deflecting in the operation process.

23 Claims, 5 Drawing Sheets

SWITCH WIRE CONNECTION DEVICE

BACKGROUND OF THE INVENTION

1. Field of the Invention

The present invention relates generally to a switch wire connection device, and more particularly to a switch wire connection device including a restriction unit, a contact plate and a metal leaf spring assembled with each other for directly electrically connecting with a conductive wire. The restriction unit has higher rigidity and is able to help in fixing the metal leaf spring and restricting the moving path thereof.

2. Description of the Related Art

A conventional switch wire connection device is a power switch device capable of connecting circuits or conductive wires. The switch wire connection device is installed on an operation panel or distribution box of an electronic or electrical apparatus for connecting the wiring circuits. The switch wire connection device has an insulation case (generally made of plastic material) and a conductive component enclosed in the insulation case and a screw for locking the wiring circuits or conductive wires of the electronic or electrical apparatus. By means of operating a switch pushbutton, the conductive component is controlled to electrically contact or separate from the wiring circuits or the conductive wires so as to close the circuit to power on the electronic or electrical apparatus or open the circuit to power off the electronic or electrical apparatus.

With respect to operation, use and structural design of the switch wire connection device, the insulation case is formed with wire sockets and screw locking holes in communication with each other. An operator can use a tool to drive the screw to lock a conductive wire plugged into the wire socket. In practice, the screw must be first positioned in the screw locking hole in a loosened state, permitting the conductive wire to plug into the wire socket. In the loosened state, the screw is often deflected. Under such circumstance, it is troublesome and hard for the operator to aim the tool at the screw to drive the screw for locking the conductive wire with the electrical contact (or termed electrical connection terminal).

To improve the above problem, there is a conventional switch wire connection device in which the insulation case and the electrical contact are formed with guide channels and guide ribs in cooperation with the spring. Such structure is relatively complicated so that the manufacturing cost is increased and generally the volume of the case is enlarged to avoid interference between the guide structures and the conductive component. The increase of the volume of the case is unbeneficial to the miniaturization of the switch wire connection terminal device and fails to meet the trend to miniaturize the switch wire connection terminal device.

Also, in some operation environments (such as the operation of the machine or the equipment will cause vibration), after a long term of use, the screw is apt to loosen. As a result, the conductive wire may loosen and detach from the case. Especially, when driving the screw mechanism to lock the conductive wires with the electrical contact, it is necessary to use a tool for tightening/untightening the screw. Such process is relatively troublesome. This is not what we expect.

There is another conventional switch wire connection device in which the case is designed with a specific internal structure and an α-shaped metal leaf spring is applied to the case for pressing the conductive wires instead of the screw mechanism. However, as known by those who are skilled in this field, the α-shaped metal leaf spring is manufactured by a special bending process and it is necessary to form a mouth section on the metal leaf spring for the other end of the metal leaf spring to swingably pass through the mouth section for pressing the conductive wire. The manufacturing process of the α-shaped metal leaf spring is quite troublesome and complicated. This is not what we expect.

To speak representatively, the conventional switch wire connection device has some shortcomings in structural design and operational form. To overcome the above shortcomings, it is necessary to redesign the insulation case, the conductive component, the electrical contact and the metal leaf spring and change the use form of the switch wire connection device and widen the application range thereof. For example, in the condition that the volume of the switch wire connection device is not increased, the switch wire connection device is redesigned to have a simplified structure, which is easy to manufacture and operate. In the conventional switch wire connection device, it is hard and troublesome for an operator to aim the tool at the screw to drive the screw for locking the conductive wire with the electrical contact. In addition, it is troublesome to assemble the guide channels and guide ribs of the insulation case and the electrical contact and the spring. Also, an α-shaped metal leaf spring is applied to the insulation case and the structure of the switch wire connection device is complicated. After redesigned, all the above shortcomings of the conventional switch wire connection device are overcome. Moreover, without using any tool, an operator can directly plug the conductive wires into the case to electrically connect with the electrical contact. The electrical contact has higher rigidity or hardness and good electrical conductivity and is able to help in fixing the metal leaf spring and restricting the moving path thereof. All these are not substantially taught, suggested or disclosed in the conventional switch wire connection devices.

SUMMARY OF THE INVENTION

It is therefore a primary object of the present invention to provide a switch wire connection device, which has a simplified structure and is easy to operate with enhanced stability of operation. The switch wire connection device includes a conductive component mounted in an insulation case, a switch pushbutton assembled with the conductive component and an electrical contact. The electrical contact has a restriction unit and a contact plate connected with the restriction unit. By means of operating the pushbutton, the conductive component is driven to selectively electrically contact or separate from the contact plate. The restriction unit defines a space, in which a metal leaf spring is assembled. The wiring circuit or conductive wire of a machine or equipment can be easily directly plugged into the space of the restriction unit and held by the metal leaf spring. In addition, during the operation process, the metal leaf spring is prevented from deflecting.

In the above switch wire connection device, the restriction unit and the contact plate are formed as an integrated structure. The restriction unit has a first side, a second side connected with the first side, a third side connected with the second side and a fourth side connected with the third side. The first, second, third and fourth sides together form a frame structure having the space for receiving the metal leaf spring. At least the second side and the fourth side serve to help in restricting the moving path of the metal leaf spring. The contact plate has a first end and a second end. The first end is connected with the first side of the restriction unit. The second end is an inclined and lifted structure and extends in a direction to contact the conductive component.

The present invention can be best understood through the following description and accompanying drawings, wherein:

DETAILED DESCRIPTION OF THE PREFERRED EMBODIMENTS

Figure 1:
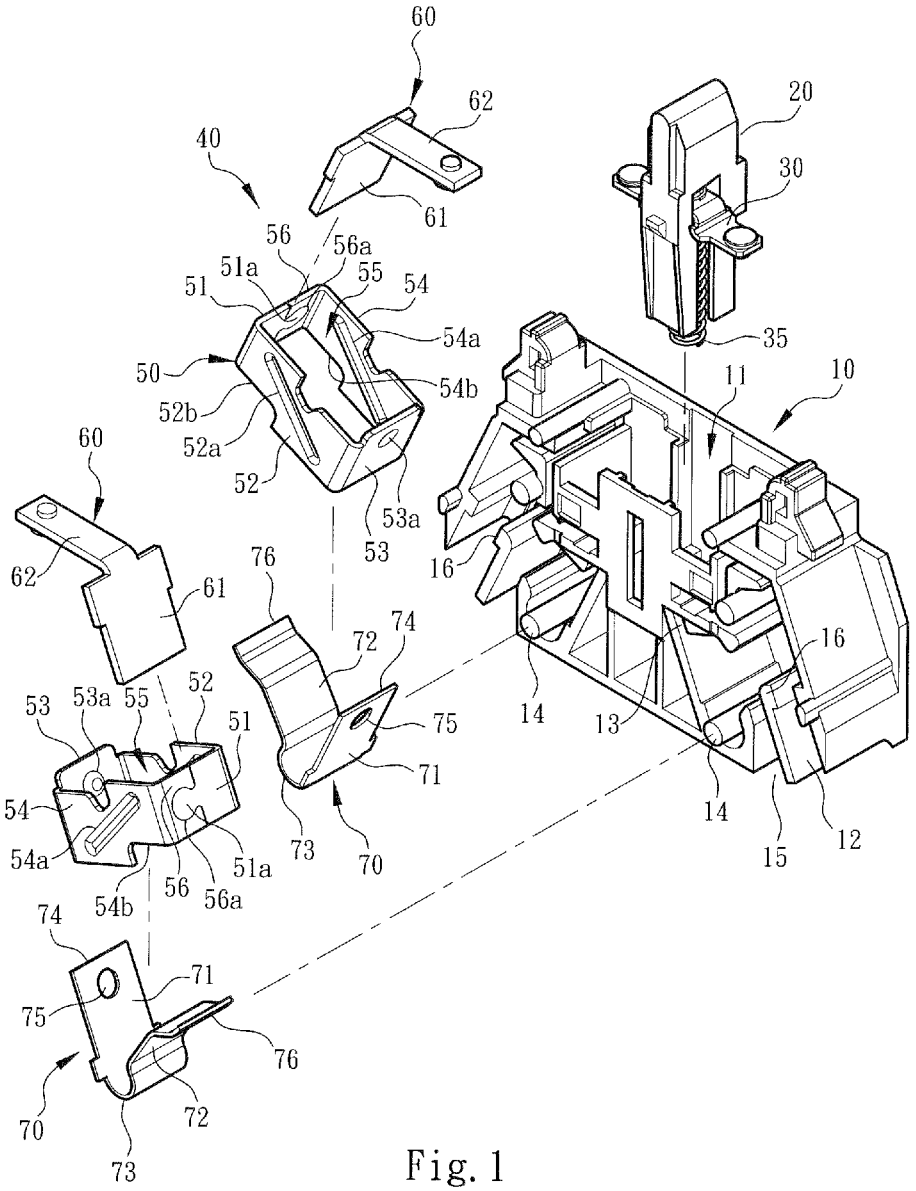
FIG. 1 is a perspective exploded view of the present invention, showing the structures of the case, the switch pushbutton, the conductive component and the restriction unit and contact plate of the electrical contact and the metal leaf spring.
Figure 2:
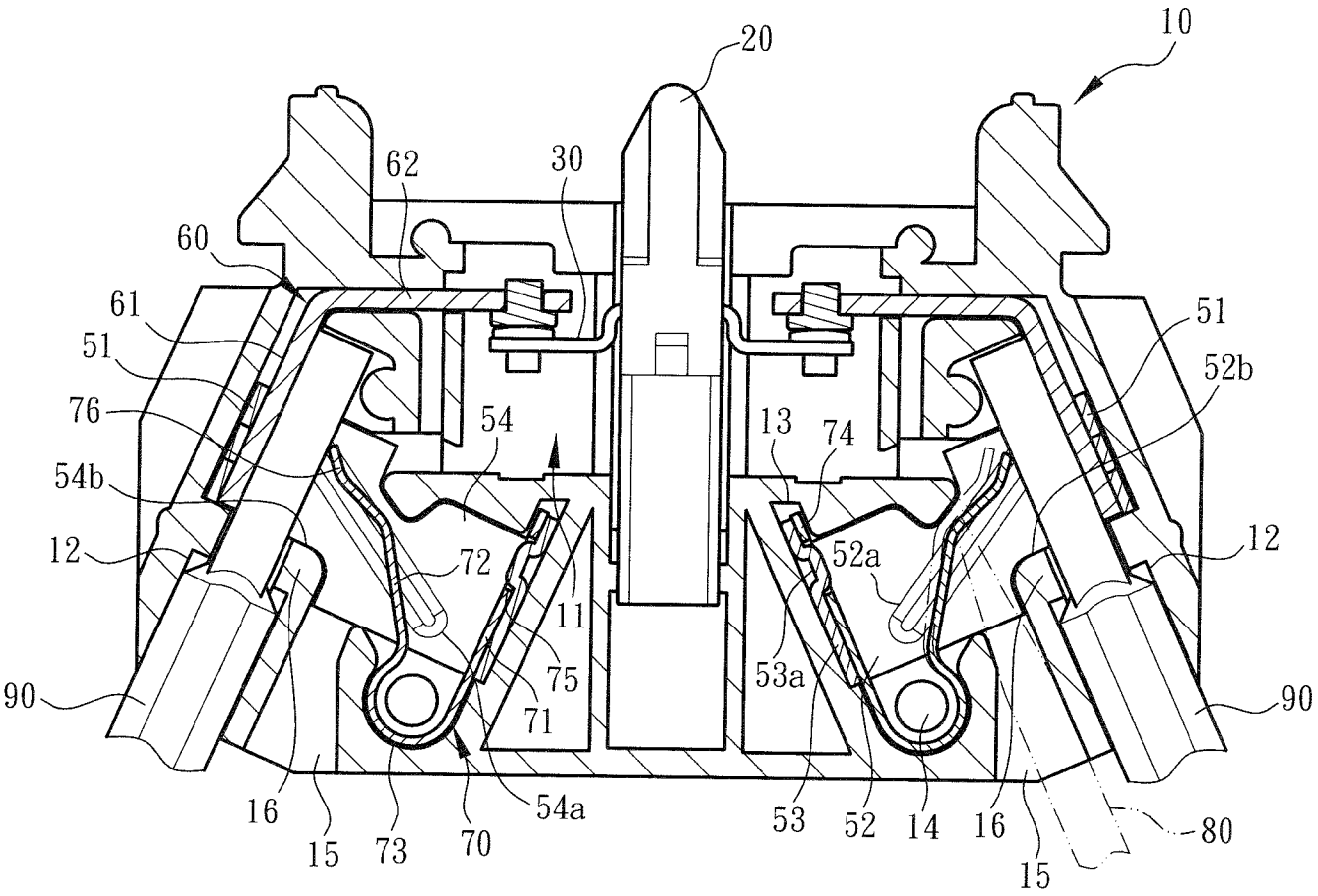
FIG. 2 is a sectional assembled view of the present invention, showing the assembly of the case, the switch pushbutton, the conductive component and the restriction unit and contact plate of the electrical contact and the metal leaf spring.

Please refer to FIGS. 1 and 2. The switch wire connection device of the present invention includes an insulation case 10 and a switch pushbutton 20 assembled with the insulation case 10. The case 10 has a cavity 11 for receiving the switch pushbutton 20. The switch pushbutton 20 is assembled with a conductive component 30 and a spring 35. (This pertains to prior art and thus will not be further described hereinafter). According to the direction of FIGS. 1 and 2, the lower end sections of two sides of the case 10 are formed with wire sockets 12 in communication with the cavity 11. The wiring circuits or conductive wires 90 of an electronic or an electrical apparatus can be plugged through the wire sockets 12 into the cavity 11 to connect with the electrical contact 40.

As shown in the drawings, there are two electrical contacts 40 disposed in the cavity 11 of the case. Each electrical contact 40 includes a restriction unit 50 and a contact plate 60 connected with the restriction unit 50. The restriction unit 50 is selectively made of a plane-plate blank material with higher rigidity or hardness, (such as iron or steel). The plane-plate blank material is manufactured into the restriction unit 50 in the form of a cuboidal frame structure as shown in FIG. 1 to be assembled with the contact plate 60.

As shown in the drawings, the restriction unit 50 has a first side 51, a second side 52 connected with the first side 51, a third side 53 connected with the second side 52 and a fourth side 54 connected with the third side 53, which together form a cuboidal frame structure having a space 55 for receive therein a metal leaf spring 70. In addition, at least the second side 52 and the fourth side 54 together help in restricting the moving path of the metal leaf spring 70.

In this embodiment, the fourth side 54 is bent toward the first side 51 and extends to form a subsidiary side 56. (For example, the fourth side 54 and the subsidiary side 56 contain an acute angle, a right angle or an obtuse angle). The subsidiary side 56 and the first side 51 are respectively formed with connection sections 56*a*, 51*a*, which can be connected with each other. It should be noted that the subsidiary side 56 and the first side 51 can be alternatively connected or fixed with each other by means of insertion, latching, riveting, welding, etc. The second and the fourth sides 52, 54 are formed with rib sections 52*a*, 54*a* for increasing the structural strength of the restriction unit 50.

As shown in the drawings, the rib section 52*a* of the second side 52 extends in a direction from the first side 51 to the third side 53 and is downward inclined. The rib section 54*a* of the fourth side 54 extends in a direction from the subsidiary side 56 to the third side 53 and is downward inclined.

As shown in FIGS. 1 and 2, the contact plate 60 has a first end 61 and a second end 62. The first end 61 is connected with the first side 51 of the restriction unit. The second end 62 is an inclined and lifted structure and extends in a direction to contact the conductive component 30. The switch pushbutton 20 selectively controls the conductive component 30 into electrical contact with the second end 62 of the contact plate or separation from the second end 62. To speak more specifically, when an operator presses the switch pushbutton 20, the conductive component 30 is driven into electrical contact with or separation from the contact plate 60 or the second end 62 thereof, whereby the electrical contact 40 is powered on or powered off.

As shown in the drawings, the metal leaf spring 70 is substantially in the form of a V-shaped body having an opening. The metal leaf spring 70 includes a first section 71, a second section 72 and a bent section 73 connected between the first and second sections 71, 72. The first section 71 has a head end 74 and an assembling section 75 in the form of a perforation. The assembling section 75 can be assembled on an assembling section 53*a* in the form of a raised section formed on the third side 53 of the restriction unit, whereby the first section 71 of the metal leaf spring is positioned in the space 55 of the restriction unit. Moreover, the head end 74 of the first section 71 of the metal leaf spring and an upper end section of the third side 53 of the restriction unit are together fixed in a recess 13 of the cavity 11 of the case. The bent section 73 of the metal leaf spring is wound on a stake 14 in the cavity 11 of the case, whereby the second section 72 of the metal leaf spring extends into the space 55 of the restriction unit and can swing within the space 55 of the restriction unit.

In this embodiment, after the metal leaf spring 70 is mounted in the cavity 11 of the case, the opening of the metal leaf spring is directed to the conductive component 30. In this case, the second section 72 is arranged in such an angle that the conductive wire 90 can be easily plugged and assembled with the case. Moreover, the plug-in direction or angle of the conductive wire 90 is approximately equal to the inclination angle of the first end 61 of the contact plate. Therefore, the conductive wire 90 can contact the first end 61 of the contact plate by larger area than the conventional structure and get closer to the conductive component 30. This enhances the electrical conduction efficiency and assembling stability. Such structure is obviously different from the α-shaped metal leaf spring or screw mechanism used in the conventional technique for locking and connecting with the conductive wire.

Referring to FIG. 2, after an operator directly plugs the conductive wire 90 into the wire socket 12, the tail end 76 of the second section 72 of the metal leaf spring presses the conductive wire 90 against the first end 61 of the contact plate into electrical contact therewith. At this time, the conductive component 30 is positioned in a position in contact with the second end 62 of the contact plate in a power-on state. When an operator presses the switch pushbutton 20, the conductive component 30 is moved downward according to the direction of the drawing, whereby the conductive component 30 is separated from the second end 62 of the contact plate into a power-off state.

Referring to FIGS. 1 and 2, the metal leaf spring 70 is such received in the restriction unit 50 that at least the second side 52 and the fourth side 54 of the restriction unit together restrict the moving path of the second section 72 of the metal leaf spring so as to prevent the second section 72 from deflecting or swinging to two sides. This helps in enhancing the stability of the move of the metal leaf spring 70 and the assembling of the metal leaf spring 70 with the conductive wire 90.

Especially, when plugging the conductive wire 90 into the cavity 11 of the case and the space 55 of the restriction unit 50, the conductive wire 90 will be restricted in the space 55 of the restriction unit 50 with high hardness. Therefore, the bare metal end of the conductive wire will not thrust or scrape and break the case as happening in the conventional technique. Also, the conductive wire will not swing within the interior of the case by an excessively large angle or twist to stretch open the case due to the operational environment, the operational situation (such as the vibration caused by the operation of the machine or equipment) or a collision due to negligence.

As shown by the phantom lines of FIG. 2, an operator can extend a tool 80 from an operation hole 15 of lower end of the case 10 into the cavity 11 and the space 55 of the restriction unit to push the second section 72 of the metal leaf spring and make the tail end 76 of the second section leave the conductive wire 90. Under such circumstance, the conductive wire 90 is released from the pressing of the second section 72 of the metal leaf spring, whereby the operator can directly detach the conductive wire 90 from the case 10.

In a modified embodiment, according to the configuration of the cavity 11 of the case, the second and fourth sides 52, 54 of the restriction unit 50 are formed with notches 52*b*, 54*b* for leaning on a shoulder section 16 formed on the case 10 or the cavity 11. Under such circumstance, the restriction unit 50 is more securely assembled with the case 10.

Figure 3:
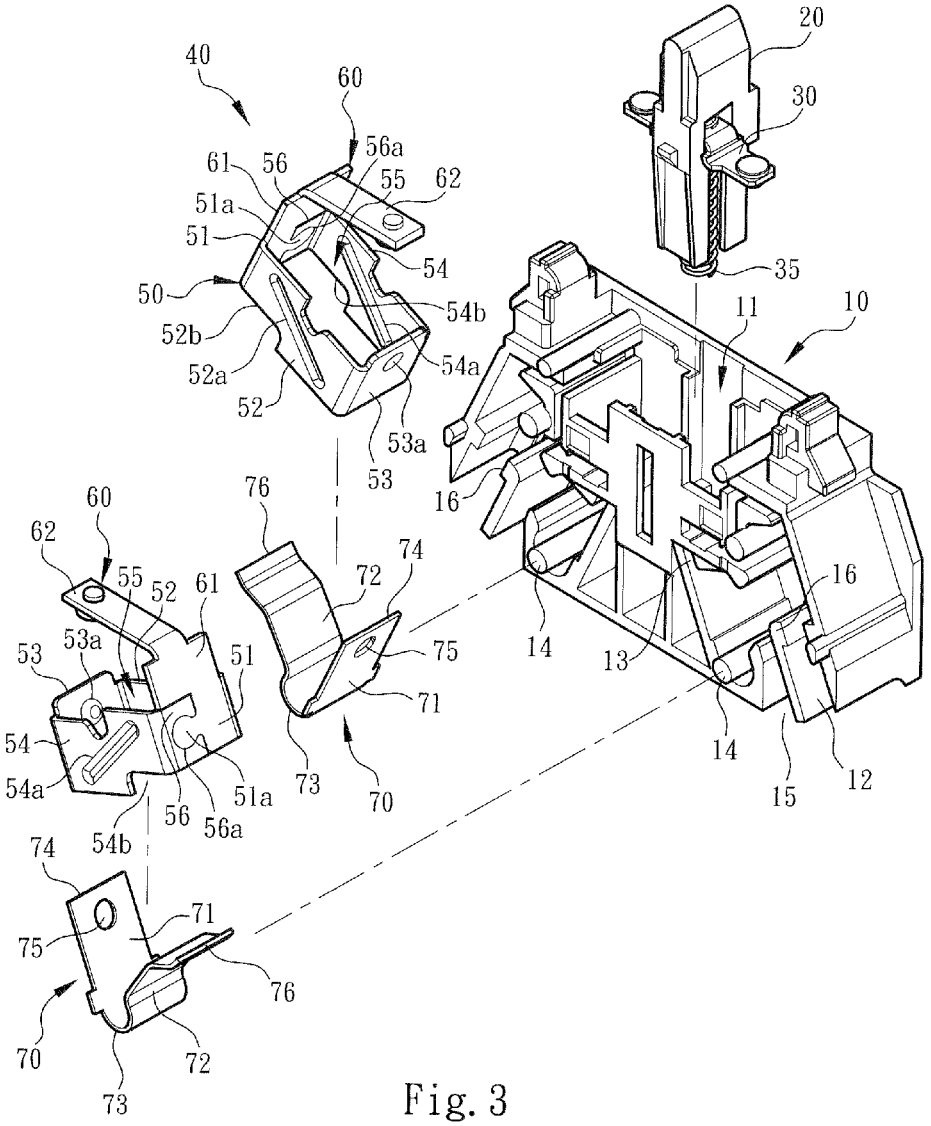
FIG. 3 is a perspective exploded view of a preferred embodiment of the present invention, showing that the restriction unit and the contact plate are formed as an integrated structure.

Please now refer to FIG. 3. In a modified embodiment, the restriction unit 50 and the contact plate 60 are formed as an integrated structure. That is, the first end 61 of the contact plate is integrally connected with the first side 51 of the restriction unit.

Figure 4:
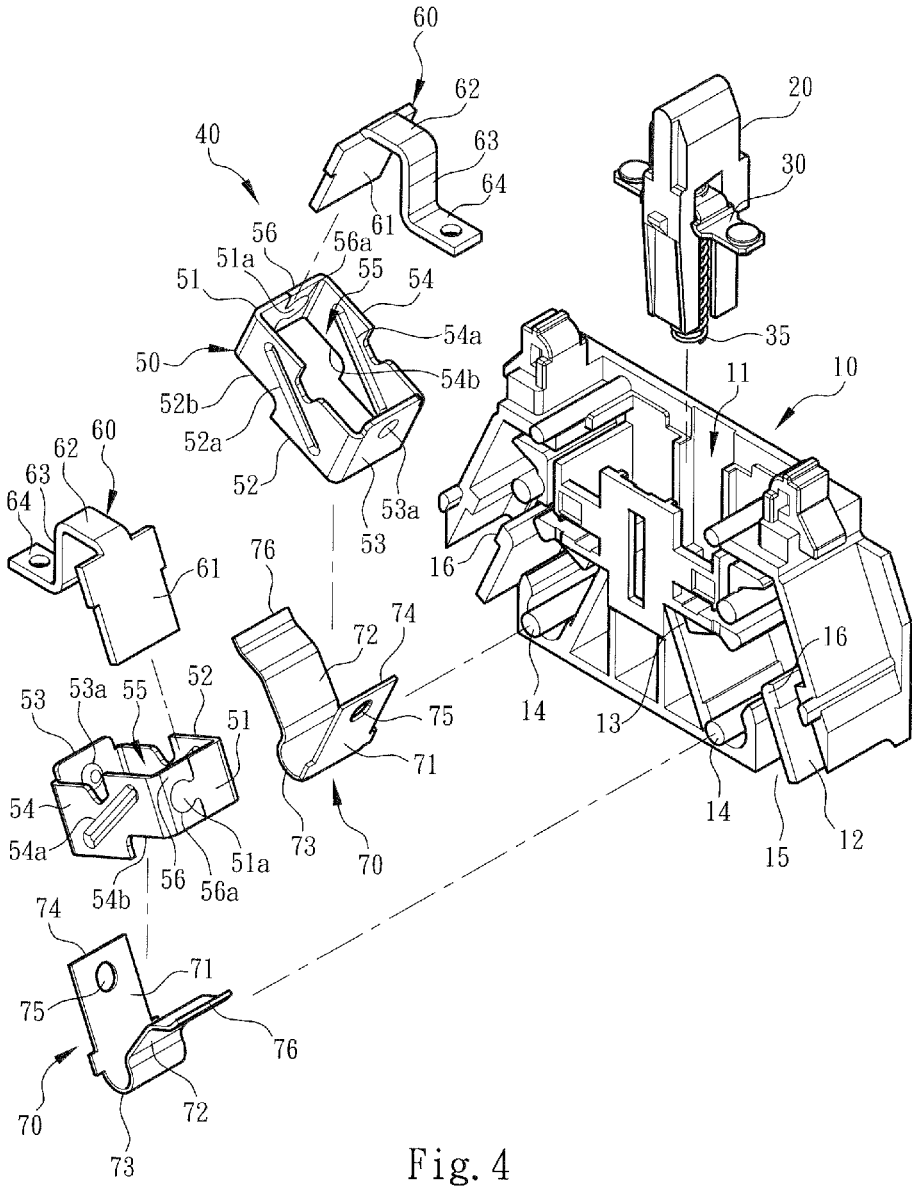
FIG. 4 is a perspective exploded view of another preferred embodiment of the present invention, showing another embodiment of the contact plate of the electrical contact.
Figure 5:
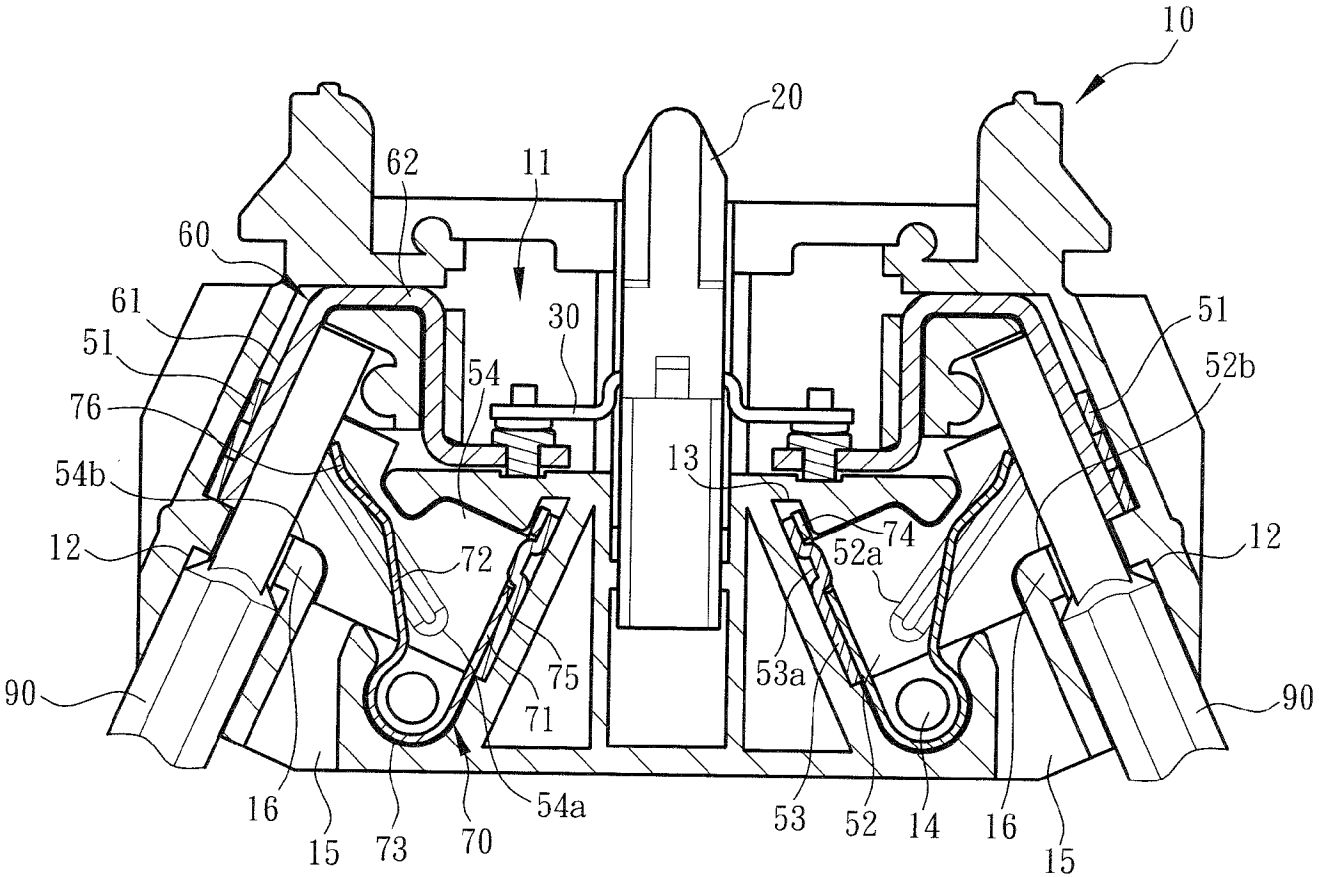
FIG. 5 is a sectional assembled view according to FIG. 4, showing the assembly of the case, the switch pushbutton, the conductive component, the conductive wires, the restriction unit and contact plate of the electrical contact and the metal leaf spring.

Please now refer to FIGS. 4 and 5. In a modified embodiment of the electrical contact 40, according to the assembling form of the case 10 (or the cavity 11) and the switch pushbutton 20, the second end 62 of the contact plate of the electrical contact 40 is bent toward the space 55 of the restriction unit (or the lower side of the drawing or the opening of the metal leaf spring 70) and extends to form a subsidiary end 63. (For example, the second end 62 and the subsidiary end 63 contain an acute angle, a right angle or an obtuse angle).

The subsidiary end 63 is further bent toward the conductive component 30 or the switch pushbutton 20 and extends to form a tail end 64. (For example, the subsidiary end 63 and the tail end 64 contain an acute angle, a right angle or an obtuse angle).

As shown in FIG. 5, after an operator operates the switch pushbutton 20 to drive the conductive component 30 to move toward the lower side of the drawing, the conductive component 30 will contact the tail end 64 of the contact plate into a power-on state. When the operator operates the switch pushbutton 20 to drive the conductive component 30 to move toward the upper side of the drawing, the conductive component 30 is separated from the tail end 64 of the contact plate into a power-off state.

To speak representatively, the switch wire connection device of the present invention meets the trend to miniaturize the switch wire connection terminal device without increasing the volume of the case. In comparison with the conventional device, the switch wire connection device of the present invention has the following advantages:

1. The case 10, the switch pushbutton 20, the conductive component 30, the restriction unit 50, the contact plate 60, the metal leaf spring 70 and the relevant components and structures have been redesigned. For example, the restriction unit 50 has a first side 51, a second side 52, a third side 53, a fourth side 54 and/or a subsidiary side 56, which together form a frame structure having a space 55 for receiving the metal leaf spring 70. The metal leaf spring 70 has a first section 71 inlaid or connected with the third side 53 of the restriction unit. The bend section 73 is wound on the stake 14 of the case 10, whereby the second section 72 is restricted to move within the space 55 of the restriction unit. An operator can directly plug the conductive wire 90 into the cavity 11. The second section 72 of the metal leaf spring presses the conductive wire 90 against restriction unit. The contact plate 60 has a first end 61 and a second end 62. The switch pushbutton 20 can selectively control the conductive component 30 into electrical contact with the second end 62 or separation from the second end 62. The structure of the switch wire connection device of the present invention is obviously different from the conventional device in use and operational form.
2. Especially, according to the conventional device, it is necessary to tighten or untighten the screw for locking or unlocking the wiring circuit or the conductive wire. This is quite troublesome. In addition, when the screw is in a loosened state, the screw is often deflected so that an operator can hardly aim the tool at the screw to drive the screw for locking the conductive wire with the electrical contact. In addition, in the conventional device, an α-shaped metal leaf spring is applied to the insulation case. The insulation case and the electrical contact are respectively formed with guide channels and guide ribs in cooperation with the spring. Such structure is relatively complicated so that the manufacturing cost is increased and the volume of the case is enlarged. Moreover, the vibration caused by the operation of the machine or the equipment will lead to loosening of the screw. As a result, the conductive wire is apt to loosen and detach from the case. The present invention overcomes all the above shortcomings of the conventional device.
3. The electrical contact 40 has higher rigidity or hardness and has good electrical conductivity so that the electrical contact is able to help in fixing the metal leaf spring 70 and guiding the metal leaf spring 70 to move a true path. In addition, the restriction unit 50 serves to correspondingly receive the metal leaf spring 70 and the conductive wire 90. This facilitates the operation of an operator. In the conventional device, the bare metal end of the conductive wire often thrusts and damages the case and the metal leaf spring often deflects or swings within the interior of the case to scrape and break the case. In addition, the conductive wire can be hardly securely held in the case. The present invention overcomes all the above shortcomings of the conventional device.

In conclusion, the switch wire connection device of the present invention is effective and different from the conventional device in space form. The switch wire connection device of the present invention is inventive, greatly advanced and advantageous over the conventional device.

The above embodiments are only used to illustrate the present invention, not intended to limit the scope thereof. Many modifications of the above embodiments can be made without departing from the spirit of the present invention.

What is claimed is:

1. A switch wire connection device comprising an insulation case and a switch pushbutton assembled with the insulation case, the case having a cavity for receiving the switch pushbutton, the switch pushbutton being assembled with a conductive component and a spring, the case being formed with wire sockets in communication with the cavity, an electrical contact being disposed in the cavity of the case, the electrical contact having a restriction unit and a contact plate connected with the restriction unit, the contact plate having a first end and a second end, the first end being connected with the restriction unit, the switch pushbutton serving to control the conductive component into electrical contact with the second end of the contact plate or separation from the second end of the contact plate, the restriction unit being formed with a space for receiving a metal leaf spring, the metal leaf spring including a first section and a second section, the first section being connected with the restriction unit and together mounted in the cavity of the case, the second section extending into the space of the restriction unit and being swingable therein.

2. The switch wire connection device as claimed in claim 1, wherein the wire sockets are formed on lower end sections of two sides of the case, whereby a conductive wire can be plugged through each wire socket into the cavity of the case, the second section of the metal leaf spring having a tail end for pressing the conductive wire against the first end of the contact plate, the plug-in angle of the conductive wire being equal to the inclination angle of the first end of the contact plate, an operation hole being formed at a lower end of the case in communication with the cavity and the space of the restriction unit.

3. The switch wire connection device as claimed in claim 1, wherein the restriction unit has a first side, a second side connected with the first side, a third side connected with the second side and a fourth side connected with the third side, the first, second, third and fourth sides together forming a cuboidal frame structure having the space, at least the second side and the fourth side together helping in restricting the moving path of the metal leaf spring.

4. The switch wire connection device as claimed in claim 3, wherein the first end of the contact plate is connected with the first side of the restriction unit, the second end being an inclined and lifted structure and extending in a direction to contact the conductive component, the second side having a rib section extending in a direction from the first side to the third side and being downward inclined, the fourth side having a rib section extending in a direction from an upper side to the third side and being downward inclined.

5. The switch wire connection device as claimed in claim 3, wherein the restriction unit and the contact plate are formed as an integrated structure, the first end of the contact plate being integrally connected with the first side of the restriction unit.

6. The switch wire connection device as claimed in claim 3, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

7. The switch wire connection device as claimed in claim 3, wherein the wire sockets are formed on lower end sections of two sides of the case, whereby a conductive wire can be plugged through each wire socket into the cavity of the case, the second section of the metal leaf spring having a tail end for pressing the conductive wire against the first end of the contact plate, the plug-in angle of the conductive wire being equal to the inclination angle of the first end of the contact plate, an operation hole being formed at a lower end of the case in communication with the cavity and the space of the restriction unit.

8. The switch wire connection device as claimed in claim 3, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

9. The switch wire connection device as claimed in claim 8, wherein the assembling section of the first section of the metal leaf spring is a perforation and the assembling section of the third side of the restriction unit is a raised section, two electrical contacts being disposed in the cavity of the case, the second and fourth sides of the restriction unit being formed with notches for leaning on a shoulder section formed in the cavity of the case.

10. The switch wire connection device as claimed in claim 3, wherein the fourth side of the restriction unit is bent toward the first side and extends to form a subsidiary side, the fourth side and the subsidiary side containing an acute angle, a right angle or an obtuse angle, the subsidiary side and the first side being respectively formed with connection sections, which can be connected with each other, the second and the fourth sides being formed with rib sections.

11. The switch wire connection device as claimed in claim 10, wherein the restriction unit and the contact plate are formed as an integrated structure, the first end of the contact plate being integrally connected with the first side of the restriction unit.

12. The switch wire connection device as claimed in claim 10, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

13. The switch wire connection device as claimed in claim 10, wherein the wire sockets are formed on lower end sections of two sides of the case, whereby a conductive wire can be plugged through each wire socket into the cavity of the case, the second section of the metal leaf spring having a tail end for pressing the conductive wire against the first end of the contact plate, the plug-in angle of the conductive wire being equal to the inclination angle of the first end of the contact plate, an operation hole being formed at a lower end of the case in communication with the cavity and the space of the restriction unit.

14. The switch wire connection device as claimed in claim 10, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

15. The switch wire connection device as claimed in claim 14, wherein the assembling section of the first section of the metal leaf spring is a perforation and the assembling section of the third side of the restriction unit is a raised section, two electrical contacts being disposed in the cavity of the case, the second and fourth sides of the restriction unit being formed with notches for leaning on a shoulder section formed in the cavity of the case.

16. The switch wire connection device as claimed in claim 14, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

17. The switch wire connection device as claimed in claim 10, wherein the first end of the contact plate is connected with the first side of the restriction unit, the second end being an inclined and lifted structure and extending in a direction to contact the conductive component, the rib section of the second side extending in a direction from the first side to the third side and being downward inclined, the rib section of the fourth side extending in a direction from an upper side to the third side and being downward inclined.

18. The switch wire connection device as claimed in claim 17, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

19. The switch wire connection device as claimed in claim 17, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

20. The switch wire connection device as claimed in claim 19, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

21. The switch wire connection device as claimed in claim 19, wherein the assembling section of the first section of the metal leaf spring is a perforation and the assembling section of the third side of the restriction unit is a raised section, two electrical contacts being disposed in the cavity of the case, the second and fourth sides of the restriction unit being formed with notches for leaning on a shoulder section formed in the cavity of the case.

22. The switch wire connection device as claimed in claim 21, wherein the second end of the contact plate of the electrical contact is bent toward the space of the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

23. The switch wire connection device as claimed in claim 22, wherein the wire sockets are formed on lower end sections of two sides of the case, whereby a conductive wire can be plugged through each wire socket into the cavity of the case, the second section of the metal leaf spring having a tail end for pressing the conductive wire against the first end of the contact plate, the plug-in angle of the conductive wire being equal to the inclination angle of the first end of the contact plate, an operation hole being formed at a lower end of the case in communication with the cavity and the space of the restriction unit.

* * * * *